United States Patent [19]

Derving

[11] Patent Number: 4,702,410

[45] Date of Patent: Oct. 27, 1987

[54] BOTTOM DESIGN OF PACKING CONTAINERS

[75] Inventor: Jackie Derving, Malmö, Sweden

[73] Assignee: Tetra Pak International AB, Lund, Sweden

[21] Appl. No.: 848,131

[22] Filed: Apr. 4, 1986

[30] Foreign Application Priority Data

Apr. 9, 1985 [SE] Sweden ..... 8501720

[51] Int. Cl.[4] ..... B65D 5/06

[52] U.S. Cl. ..... 229/184; 229/137; 229/138

[58] Field of Search ..... 229/17 R, 17 G, 137, 229/138, 184

[56] References Cited

U.S. PATENT DOCUMENTS

| | | | |
|---|---|---|---|
| 663,133 | 12/1900 | Shipley, Jr. | 229/137 |
| 681,323 | 8/1901 | Houghland | 229/184 |
| 4,113,168 | 9/1978 | Shirakawa | 229/184 |
| 4,192,446 | 3/1980 | Naito | 229/17 R |

*Primary Examiner*—Stephen Marcus
*Assistant Examiner*—Gary E. Elkins
*Attorney, Agent, or Firm*—Burns, Doane, Swecker & Mathis

[57] ABSTRACT

A bottom design for packing containers of the type manufactured by folding and sealing of plastic laminated packing material. To prevent the absorption of liquid contents by the fibrous carrier layer of the material on unprotected cut edges a folding pattern is created in accordance with the invention which ensures that all cut edges (11) at the bottom (4) of the packing container are situated under protecting parts of the packing material.

13 Claims, 6 Drawing Figures

BOTTOM DESIGN OF PACKING CONTAINERS

BACKGROUND OF THE INVENTION

This invention relates to paperbound cartons or packing containers for liquids, such as milk and juice, and to blanks from which such cartons are manufactured.

Packing containers have been made by folding and sealing of a packing laminate with four side panels, a top part and a bottom part consisting of a number of material panels which comprise two main bottom panels connected to opposite side walls, two fold-in bottom panels connected to intermediate side walls and four fold-back panels joining together the main bottom panels and the fold-in bottom panels, these bottom panels, after folding and sealing to one another, jointly forming the bottom part.

The invention also relates to a corresponding bottom design used on a packing container blank for the formation of a packing container in which the packing container blank is of the type which comprises top, bottom and side panels, separated by crease lines, the bottom wall panels comprising two main bottom panels, two fold-in bottom panels, and four fold-back panels combining the main bottom panels and the fold-in bottom panels.

DESCRIPTION OF THE PRIOR ART

In the manufacture of packing containers e.g. milk and juice containers, a laminated packing material is used which usually comprises a carrier layer of paper which is coated on either side with thermoplastic material, e.g. polyethylene. The thermoplastic imparts to the material good liquid-tightness and makes it possible at the same time in a simple manner with the help of heat-sealing to obtain liquid-tight joins. The packing laminate also can include further layers of other materials, e.g. aluminium foil, in order to give the material better gas tightness.

The packing container blanks are manufactured from weblike packing laminate which after application of the different layers is cut out so as to form blanks which, either in connection with the cutting out or thereafter, are converted through folding and sealing into finished packing containers. To facilitate the conversion of the blanks into finished packing containers the packing laminate is also provided with a pattern of folding lines, usually crease lines, along which the materials can simply be folded with the help of automatic packing machines. The packing laminate can also be provided with different types of opening arrangements, such as perforation lines or the like, but the design and detailed layout of the laminate are well-known in principle within the packaging branches and therefore need not be described at any more detail.

During the cutting out mentioned earlier of the individual blanks from a coherent, thermoplastic coated laminate web the inner layer will be exposed in the cut edges formed in the process. Since the carrier layer often consists of a material with good absorption capacity, e.g. paper, it is essential that these cut edges be placed in such a manner that they will not come into contact with the contents when the packing container has been completed. In certain types of packing containers, e.g. ridge packages (also with plane top) parts of the cut edges, when folded, according to a conventional pattern, will be located inside the packing container and these parts of the cut edges must therefore be protected from contact with the packed contents if high demands on tightness and hygiene are to be maintained, since otherwise the contents will be absorbed into the fibrous layer of the packing laminate. In gas-tight material such as packing laminate comprising layers of e.g. aluminium foil, the gas-tightness will also be impaired, since the gas-tight layers will not be closely adjoining one another in the areas where the cut edges are exposed.

In a packing container of the conventional ridge-type which is manufactured from preformed blanks, cut edges will appear inside the packing container on the one hand along a vertical longitudinal join, and on the other hand in a central area of the bottom where folded-in material lugs meet. The longitudinal join can be provided with a covering strip or a so-called crimped-over longitudinal join which prevents contact with the contents. These solutions have been known earlier, but no solution has been offered until now which in a simple manner makes possible a complete sealing also of the exposed cut edges present at the bottom of the packing container. Earlier solutions suggest, among other things, different types of foldings which deviate from the normal folding pattern and on one hand become more complicated to realize, and on the other hand, involve larger consumption of material (U.S. Pat. No. 3,412,922). Another solution purposes that on a substantially conventional bottom design different types of seals are applied over the parts of the cut edges which otherwise would come into contact with the contents (U.S. Pat. No. 3,913,825). This solution is also comparatively complicated and disadvantageous, since it makes necessary the application and use of additional material.

The previously known bottom designs, where it was endeavoured to avoid direct contact between exposed cut edges and contents, are thus relatively complicated in that the design involves increased material consumption and consequently higher costs. Moreover, the bottom designs are difficult to fold with automatic machines of a conventional type and give thick, uneven results which increase the risk of channel formation and leakages between the different layers.

OBJECTS AND SUMMARY OF THE PRESENT INVENTION

It is an object of the present invention to provide a bottom design which is not subject to the aforementioned disadvantages but which provides an effective sealing of the cut edges in a comparatively simple manner.

It is a further object of the present invention to provide a bottom design with protected cut edges, where the folding pattern substantially coincides with a conventional folding pattern, at the same time reducing material consumption to a minimum and eliminated any need for additional material in the form of strips, hot-melt or the like.

These and other objects have been achieved in accordance with the invention in that a bottom design of the type described in the introduction has been given the characteristic, that the fold-in bottom panels and the fold-back panels in a section of their free bottom edge remote from the side walls have a number of edge panels which during the formation of the bottom part make possible a double-folding of the laminate so that the said section of the edge will be placed in a protected position located between the fold-in bottom panels and the fold-back panels. Corresponding bottom designs on a blank for conversion to a packing container of the type mentioned at the beginning have been given the characteristic in accordance with the invention that the bottom wall panels along a free bottom edge have a number of edge panels which are divided from the fold-in the bottom panels and the fold-back panels by means of creases lines which make possible a folding of the edge panels in relation to the adjoining bottom wall panels.

Preferred embodiments of the bottom design in accordance with the invention on a finished packing container as well as on a blank for the manufacturé of packing containers have been given the characteristics in accordance with the invention which are evident from the subsidiary claims.

The bottom design in accordance with the invention makes it possible to achieve with limited material consumption a bottom design in which the cut edges of the packing laminate are completely covered so that all contact between the cut edges and contents packaged in the packing container can be avoided. Since the cut edges are protected by folding in of, or covering with, material present already, no application of any additional material of any kind is required thus which facilitating appreciably the manufacture of packing containers of this bottom design.

BRIEF DESCRIPTION OF THE DRAWINGS

Two preferred embodiments of the bottom design in accordance with the invention will now be described in more detail with special reference to the attached drawing which schematically shows the bottom design in different stages during the conversion of a packing container blank to a finished packing container.

DETAILED DESCRIPTION OF THE PREFERRED EMBODIMENTS

Two embodiments of the bottom design in accordance with the invention are described in the following detailed description and are illustrated in the figures partly in; and form of flat packing container blanks, partly in the form of blanks wholly or partly converted to finished packing containers and sealed. Furthermore, the bottom design is applied generally to the type of packing containers which are called ridge packages but also can be employed with a flat top part. This main type of package is well-known and described in more detail e.g. in Swedish patent specification No. 377.313 to which reference is made.

Figure 1:
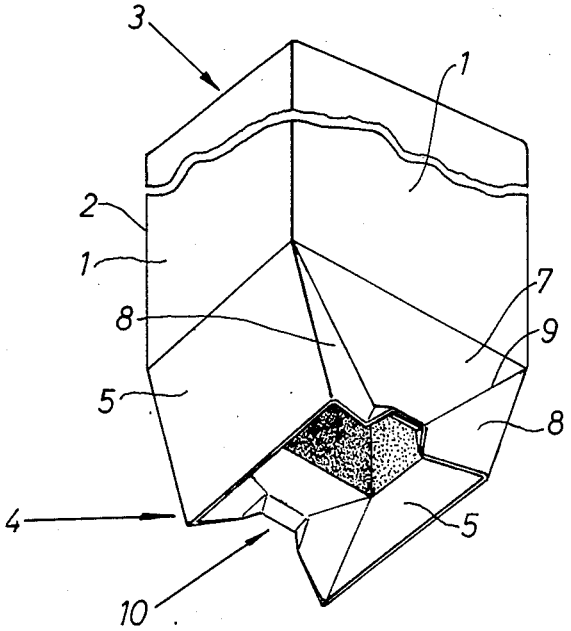
FIG. 1 shows in perspective a bottom design in accordance with the invention during formation on an otherwise conventional packing container.

FIG. 1 shows how the bottom design in accordance with the invention is realized on a known packing container of the flat ridge-type, this packing container comprises four rectangular side panels 1 which are divided from one another and folded along four side crease lines 2 so that a tubular packing container body of substantially square cross section is produced. The packing container furthermore comprises a top part 3 which is of the flat ridge type and a bottom part 4 which is designed in accordance with the invention. The packing container which, apart from the bottom part 4 is of a known type, is manufactured from conventional packing material, e.g. a laminate which comprises a central carrier layer of fibrous material coated on either side with a layer of liquid-tight and heat sealable material, e.g. a thermoplastics such as polyethylene. Further layers may also be present e.g. gas-tight layers of aluminium foil or the like. The packing laminate is manufactured by means of a conventional technique, such as a web of fibrous carrier layer coated successively with different material layers as desired, whereupon it is provided with crease lines in the required pattern and divided up into individual blanks. The conversion of the packing laminate to individual packing containers may be done either while the packing laminate continues to be in form of a web, directly after the dividing up into individual sheets, or on a latter occasion. The manufacturing process as well as the composition of the packing laminate, the crease line pattern and the cutting out are conventional and well-known to those versed in the art, and are not described in more detail in the present context. For the same reason only the bottom part of the packing container or the packing container blank is illustrated in certain figures and it is assumed that any parts not shown are of any conventional type.

Figure 2:
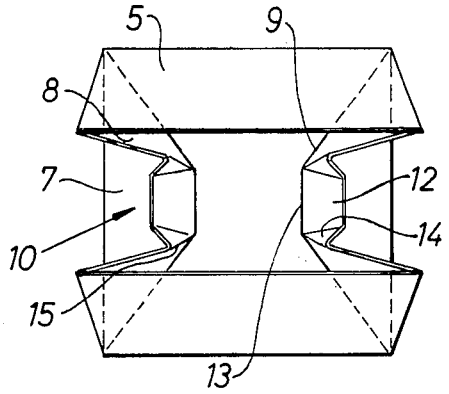
FIG. 2 shows the bottom design according to FIG. 1 from underneath.
Figure 3:
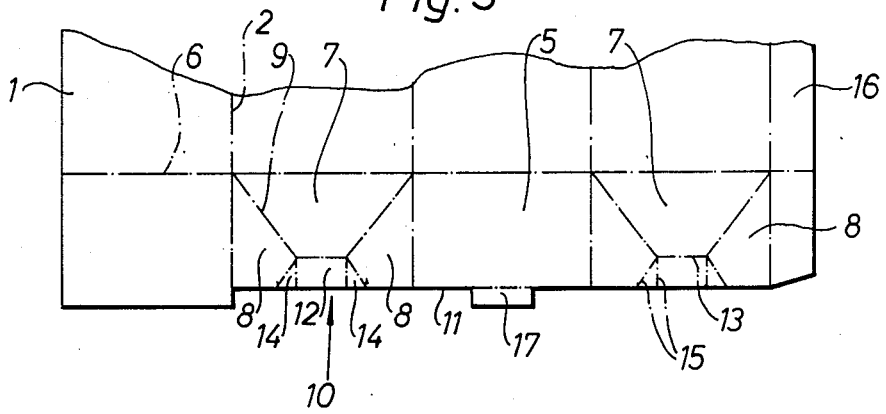
FIG. 3 shows a part of a packing container blank where a first embodiment of the bottom design in accordance with the invention is used.
Figure 4:
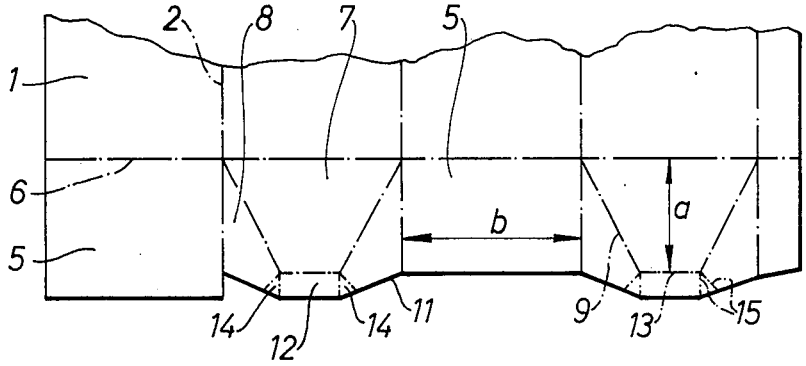
FIG. 4 shows a part of a packing container blank where a second embodiment of a bottom design in accordance with the invention is used.

The bottom design in accordance with the invention is shown in general in FIGS. 1 and 2 from which it is evident that the bottom part 4 comprises two substantially rectangular main bottom panels 5 which are connected in a foldable manner to two opposite side panels via a transverse bottom crease line 6, which extends substantially at a right angle to the vertical side crease lines 2 of the packing container and which runs along the entire circumference of the packing container, that is to say transversely over the whole width of the packing container blanks (FIGS. 3 and 4). On the other pair of opposite side panels 1, the bottom crease line 6 delineates two fold-in bottom panels 7 which are of a width which corresponds to the width of the adjoining side panel 1 along crease line 6 but which tapers in the direction away from the side panel. Between each fold-in bottom panel 7 and the main bottom panels 5 situated adjacent thereto two fold-back panels 8 are provided, which are connected in a foldable manner to the fold-in bottom panels 7 via oblique crease lines 9 and to the main bottom panels 5 via parts crossing the bottom crease lines 6 of the side crease lines 2. On a bottom part formed in a conventional manner the fold-in bottom panels 7 as well as the fold-back panels 8 are triangular and the oblique crease lines situated between the said panels meet in a common point at the lower end of the panel at the free edge remote from the side panel 1. When the bottom is formed through folding-in of the fold-in panels under the main panels of the bottom this point will be critical since here the cut edges will be exposed and accessible to the contents.

In the bottom design in accordance with the invention the previously triangular fold-in bottom panels and fold-back panels have been given a four-sided form in that their corner facing towards the free bottom edge 11 of the bottom part 4 has been delineated by means of crease lines and divided into a number of foldable edge panels 10. More precisely, the fold-in bottom panel 7 is divided from an edge panel, situated centrally called primary panel 12, with the help of a primary crease line 13 which extends parallel with the free bottom edge 11 and which is of a length substantially corresponding to a quarter of the distance between two adjoining side crease lines 2. The primary panel 12 thus constitutes a rectangular continuation of the fold-in bottom panel 7 and is limited on either side by further triangular edge panels which are called secondary panels 14. The secondary panels 14 serve as fold-back panels and are divided from the primary panel 12 and the adjoining fold-back panel 8 respectively by means of secondary crease lines 15 which extend at an angle to the free bottom edge 11. More precisely, the two secondary crease lines 15 which delineate the side of the primary panel 12 extend substantially at a right angle to the bottom edge 11, whilst the two secondary crease lines 15 which divide the secondary panels 14 from the fold-back panels 8 extend substantially at a right angle to the crease line 9, which separates the fold-in bottom panels 7 from the fold-back panels 8. All the above information on angles and directions relate to the flat state of the packing container, e.g. as illustrated in FIG. 3. On conversion of the packing container blank to finished packing containers the bottom design is folded along the crease lines in such a manner, that the two fold-in bottom panels 7 form part of the inside of the bottom, that is to say, they end up inside the packing container whereas the main bottom panels 5 form the outside of the bottom and the remaining parts of the inside. On folding of the main bottom panels and fold-back panels 8 will be placed between the fold-in bottom panels 7 and the main bottom panels 5, whereas when the forming of the packing container has been completed the edge panels 10, will be located, folded back over 180°, in a protected position between the fold-in bottom panels 7 and adjoining fold-back panels 8, so that the free bottom edge 11 of the edge panels is completely isolated from any contents subsequently filled into the packing container.

The folding of the edge panels 10 in connection with the forming of the bottom part 4 of the package is evident most clearly from FIGS. 1 and 2 which show the bottom design in an intermediate position during the forming of the bottom. During the conversion of the packing container blank from the flat condition to the finished packing container the blank is folded first in a conventional manner over 90° around each side crease line 2, so that the two outer side panels 1 will meet and be sealed to each other with the help of a longitudinal sealing panel 16. Then the top and bottom parts of the packing container are formed, each by itself, through folding in of the respective material panels. On forming a conventional bottom part of the two fold-in bottom panels 7 are folded in towards each other by being turned around the corresponding part of the bottom crease line 6 at the same time as the two main bottom panels 5 are folded towards each other and around the bottom crease line 6, so that the main bottom panel will be on the outside of the fold-in bottom panels. In so doing the fold-back panels 8 joining together the fold-in bottom panels 7 and the main bottom panels 5 will be folded outwardly around the crease line 9 situated between the fold-back panels 8 and the fold-in bottom panels 7, and, in the bottom design in accordance with the invention the edge panels 10 are also folded at the same time around the primary and secondary crease lines 13, 15. More precisely, the central primary panels are folded outwardly over 180° around the primary crease lines 13 so that they rest against the outside of the respective fold-in bottom panels 7, at the same time as the triangular secondary panels 14 serving as fold-back panels are folded around the secondary crease lines 15. After completion of the folding process the parts of the bottom edge 11 which delineate the primary panels 12 will be located in a protected position between the fold-in bottom panels 7 and the fold-back panels 8 which rest against each other and are sealed to each other with the help of the outer thermoplastic layers. The edge 11 as a result will no longer be situated inside the packing container, and the risk of an absorption of the contents into the said cut edge is thus eliminated. However, the part of the bottom edge 11 which is located along the main bottom panel 5, which is overlapped by the main bottom panel situated opposite, will be located inside the packing container and will be in contact with the contents in the space at the bottom of the packing container which is not covered by the two folded-in fold-in bottom panels 7. This part of the bottom edge 11 can be protected in a conventional manner by providing it with a projecting tongue 17 which is folded back over 180° so that it will be located between parts of the two main bottom panels 5 which in the finished state of the bottom part overlap each other and are sealed to each other. This is part of the prior art, though, and need not be described in more detail in the present context.

Figure 5:
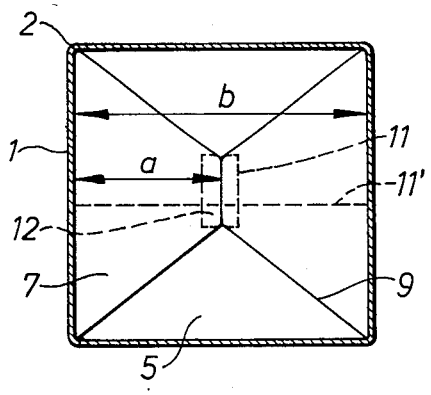
FIG. 5 shows in section a packing container with a bottom designed in accordance with the second embodiment of the bottom design in accordance with the invention.
Figure 6:
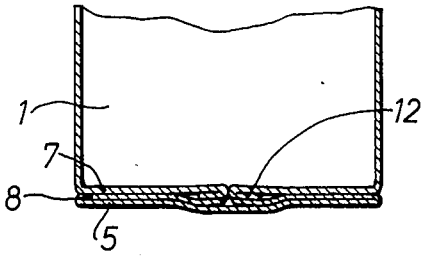
FIG. 6 shows the bottom design in accordance with FIG. 5 from the side and in section.

In a second embodiment of the bottom design in accordance with the invention the shape and size of material panels have been modified so that the need for a separate sealing tongue 17 on the bottom edge 11 disappears at the same time as further safety against leakage and absorbtion of the contents into the carrier layer of the packing laminate is achieved. This second, modified embodiment of the bottom design in accordance with the invention is illustrated in more detail in FIGS. 4, 5 and 6. The parts of the packing container blank and the packing container which are similar to the corresponding parts in the first embodiment described of the bottom design in accordance with the invention, have been given corresponding reference numerals and will not be described in detail, since their design and function are identical with what has been described earlier. The greatest difference between the packing container blank in FIG. 4 and the packing container blank in FIG. 3 consists in that the free bottom edge 11 of the blank is no longer straight in the region of the edge panels 10 and fold-back panels 8, but bends and turns outwards, so that the distance between the free bottom edge 11 and the bottom crease line 6 which joins together appurtenant fold-in bottom panels 7 with adjoining side panels 1 of the packing container is greatest at the central part of the cut edge 11 situated right before the primary panel 12 when the panels are in a common plane, such as when the packing container blank is unfolded. The distance between the primary crease line 13 and the corresponding section of the crease line 6 will be greater in this second embodiment and, more precisely, the distance between the bottom crease line 6 and the primary crease line 13 (the distance a) is equal to, or slightly greater (1–5%) than half the width (distance b) of the adjoining main bottom panel 5. After conversion of the packing container blank and folding of the bottom panels to form a flat base the two outer end edges of the fold-in bottom panels 7 defined by the primary crease lines 13 will meet in the center of the bottom surface of the packing container and they can be made to join tightly to each other, so that after sealing together of the different panels of the bottom design they completely cover and seal off the part of the edge line 11 which previously came into contact with the contents and, therefore, had to be provided with the fold-in tongue 17. As a result, the bottom design in accordance with the invention can ensure a completely sealed off bottom which not only protects all cut edges from contact with the contents, but also possesses such evenness that the risk of leakage via channels at the transition between different material thickness etc, is avoided. The finished and sealed bottom design in accordance with the second embodiment of the invention is illustrated in FIGS. 5 and 6, where the closeness between the fold-in points of the two fold-in bottom panels 7 is clearly illustrated. FIG. 6 moreover makes evident how the folded-in primary panels 12 are located between fold-in bottom panels 7 and the main bottom panels 5 forming the outside base of the packing container.

It is of course possible to embody the invention in other specific forms than those of the preferred embodiment described above. This may be done without departing from the essence of the invention. The preferred embodiment is merely illustrative and should not be considered restrictive in any way. The scope of the invention is embodied in the appended claims rather than in the preceding description and all variations and changes which fall within the range of the claims are intended to be embraced therein.

I claim:

1. A container bottom for packing container blanks of the type comprising a number of top, bottom, and side panels separated by crease lines, said bottom comprising two main bottom panels, two fold-in bottom panels each having a first edge remote from said side panels and four fold-back panels each having a free edge, said fold-back panels joining together the main bottom panels and the fold-in bottom panels, said fold-back panels and said fold-in bottom panels having a number of edge panels which are divided from the fold-in bottom panels and the fold-back panels by means of crease lines which make possible a folding of the edge panels in relation to adjoining panels, said edge panels include primary panels and secondary panels serving as secondary fold-back panels, said secondary panels being situated on opposite sides of each of said primary panels.

2. A container bottom in accordance with claim 1, wherein said primary and secondary panels are divided from each other by means of secondary crease lines which extend at an angle to said first edges.

3. A container bottom in accordance with claim 1, wherein said free edges are common to both the fold-back panels and the edge panels and form a straight line when the panels are in a common plane.

4. A container bottom in accordance with claim 1, wherein said free edges are common to both the fold-back panels and the edge panels and are convexly curved when the panels are in a common plane.

5. A container bottom in accordance with claim 4, wherein the distance between the free edges and a bottom crease line which joins appurtenant fold-in bottom panels with adjoining side panels is greatest at the central part of each free edge situated adjacent one of the primary panels when the panels are in a common plane.

6. A container bottom in accordance with claim 5, wherein each primary panel is divided from each fold-in bottom panel by means of one of said crease lines constituting a primary crease line which extends parallel with the bottom crease line situated between the fold-in bottom panel and the adjoining side wall of the packing container.

7. A container bottom in accordance with claim 6, wherein the distance between the bottom crease lines and the primary crease lines is at least equal to half the width of the adjoining main bottom panels.

8. A container bottom for packing containers of the type manufactured by folding and sealing of a packing laminate and having four side panels, a top part and a bottom, said bottom comprising:

a first main bottom panel having a first edge which is connected to a first of said side panels;

a second main bottom panel having a first edge which is connected to a second of said side panels disposed opposite said first of said side panels;

two fold-in bottom panels each having a first edge connected to one of said side walls intermediate said first and second of said side walls and a second free edge;

four fold-back panels joining together said main bottom panels and said fold-in bottom panels and having free edges remote from said side walls, said main bottom panels, said fold-in bottom panels and said fold-back panels, after complete folding and sealing to one another, jointly forming said bottom; said complete folding including a first folding which occurs along vertical fold lines extending between said main bottom panels and said fold-back panels and along oblique fold lines extending between said fold-back panels and said fold-in bottom panels, and a second folding which occurs along primary crease lines extending between the oblique fold lines adjacent each of said fold-in bottom panels, and along secondary crease lines extending between ends of said primary crease lines and said free edges of said fold-in bottom panels and fold-back panels, said first and second foldings providing said free edges of said fold-in bottom panels and fold-back panels in a protected position located between said fold-in bottom panels and said fold-back panels.

9. A container bottom in accordance with claim 8, wherein said primary fold lines and said secondary fold lines define three edge panels constituting a portion of each of said fold-in panels along the free edge thereof, said three edge panels being constituted of a primary panel and two secondary panels located on opposite sides of said primary panel.

10. A container bottom in accordance with claim 9, wherein said secondary panels are substantially triangular and serve as fold-back panels.

11. A container bottom in accordance with claim 9, wherein said primary crease lines extend parallel with said free edges of said fold-in bottom panels and said fold-back panels.

12. A container bottom in accordance with claim 9, wherein said primary panels are folded over 180° and rest against adjoining fold-in bottom panels in the finished state of the packing container.

13. A container bottom in accordance with claim 9, wherein said primary panels and adjoining fold-in bottom panels rest in a liquid-tight manner against one another and are sealed together in the finished state of the packing container.

* * * * *